US007017507B2

(12) United States Patent
Hattori et al.

(10) Patent No.: US 7,017,507 B2
(45) Date of Patent: Mar. 28, 2006

(54) STEERING ASSEMBLY FOR WATERCRAFT

(75) Inventors: Toshiyuki Hattori, Hamamatsu (JP); Kenichi Otsuka, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/902,733

(22) Filed: Jul. 29, 2004

(65) Prior Publication Data

US 2005/0235894 A1 Oct. 27, 2005

(30) Foreign Application Priority Data

Apr. 26, 2004 (JP) ..... 2004-129231

(51) Int. Cl.
*B63H 25/10* (2006.01)

(52) U.S. Cl. ..... 114/144 R; 114/55.52

(58) Field of Classification Search ..... 114/55.5, 114/55.53, 55.57, 144 R, 55.52
See application file for complete search history.

(56) References Cited

U.S. PATENT DOCUMENTS

| | | | | |
|---|---|---|---|---|
| 5,076,190 | A * | 12/1991 | Iikawa | 114/55.53 |
| 6,062,154 | A * | 5/2000 | Ito | 114/55.57 |
| 6,145,458 | A | 11/2000 | Hattori | |
| 6,202,584 | B1 * | 3/2001 | Madachi et al. | 114/144 R |
| 6,276,291 | B1 * | 8/2001 | Lapointe et al. | 114/144 R |

* cited by examiner

*Primary Examiner*—Lars A. Olson
(74) *Attorney, Agent, or Firm*—Knobbe, Martens, Olson & Bear, LLP

(57) ABSTRACT

A watercraft can include seats having hip supports for the riders including an operator and/or passengers thereof. Additionally, the watercraft can include a handlebar cover that is configured to prevent water from entering a steering mechanism. For example, the handlebar cover can include a lower portion and an upper portion extending downwardly over the lower portion.

21 Claims, 12 Drawing Sheets

240

STEERING ASSEMBLY FOR WATERCRAFT

PRIORITY INFORMATION

This application is based on and claims priority to Japanese Patent Application No. 2004-129231 filed Apr. 26, 2004, the entire contents of which is hereby expressly incorporated by reference.

BACKGROUND OF THE INVENTION

1. Field of the Invention

The inventions disclosed herein generally relate to features of watercraft, and more particularly, to water preclusion and seating for watercraft.

2. Description of the Related Art

Personal watercraft have become popular in recent years. This type of watercraft is sporting in nature; it turns swiftly and is easily maneuverable. Personal watercraft today, may carry one operator and one or more passengers.

Personal watercraft typically include a steering mechanism to steer the watercraft. The steering mechanism often includes a handlebar that is covered with a soft cushion material. Additionally, personal watercraft handlebars typically include controls for the watercraft, such as, for example a throttle lever, a start switch, and a kill switch. In order to accommodate operators of different sizes and different riding preferences, adjustable steering mechanisms have been incorporated into commercially available personal watercraft for several years.

SUMMARY OF THE INVENTION

An aspect of at least one of the inventions disclosed herein includes the realization that a certain component of prior art steering systems for watercraft can allow water spray to enter into the steering mechanism. For example, the steering mechanisms of known personal watercraft usually comprise a handlebar mounted on a shaft that extends through a deck of the watercraft. The upper portion of the handlebar includes a cover member. At a location on the steering assembly, a boundary is defined between the rotatable part of the steering assembly and either a lower fixed portion or the upper deck itself. This boundary is typically defined in a plane that extends generally perpendicular to the steering shaft axis. This plane is either generally horizontal or inclined upwardly toward the front of the watercraft. Because water spray is created at the front of the boat and travels rearwardly toward the steering assembly, such water spray can enter the steering mechanism at the boundary between the rotatable part of the steering assembly and the stationary or fixed part. As such, the water spray can accelerate the buildup of foreign material on components of the steering assembly.

In accordance with some embodiments, a steering assembly for watercraft having a hull is provided. The steering assembly comprises a steering post section supported by the hull of the watercraft and a steering handle section that is rotatable relative to the steering post section about a steering axis. A cover member is connected to the steering handle section and extends from the steering handle section toward the steering post section so as to extend over a boundary between the steering post section and the steering handle section.

In accordance with some embodiments, a watercraft comprises a hull, a propulsion device supported by the hull and configured to generate thrust to propel hull. The hull defines a rider's area, the rider's area including a seat and a steering assembly disposed forwardly from the seat. The steering assembly is configured to allow an operator of the watercraft to steer the watercraft. The steering assembly also comprises a steering post section and a steering handle section, the steering handle section including a steering member configured to be grasped by a human. The steering handle section is configured to be rotatable relative to the steering post section about a steering axis. A steering assembly cover extends over a boundary between the steering handle section and the steering post section.

In accordance with some embodiments, a watercraft comprises a hull, a propulsion device for propelling the hull, and a steering device configured to allow an operator to steer the watercraft. The steering device comprises a steering post section and a steering handle section which is rotatable relative to the steering post section. Additionally, the watercraft includes means for shielding a boundary between the steering post section and the steering handle section from water spray.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENT

FIGS. 1–4 illustrate a watercraft incorporating a steering mechanism and seating arrangement configured in accordance with a preferred embodiment. The steering mechanism and seating arrangement have particular utility in the environment of use of a personal watercraft, and therefore are illustrated in connection with such a vehicle. It is contemplated, however, that the steering mechanism and/or seating arrangement, together or separately, can be used with other types of vehicles as well, such as, for example, but without limitation, small jet boats and other vehicles.

Figure 1:
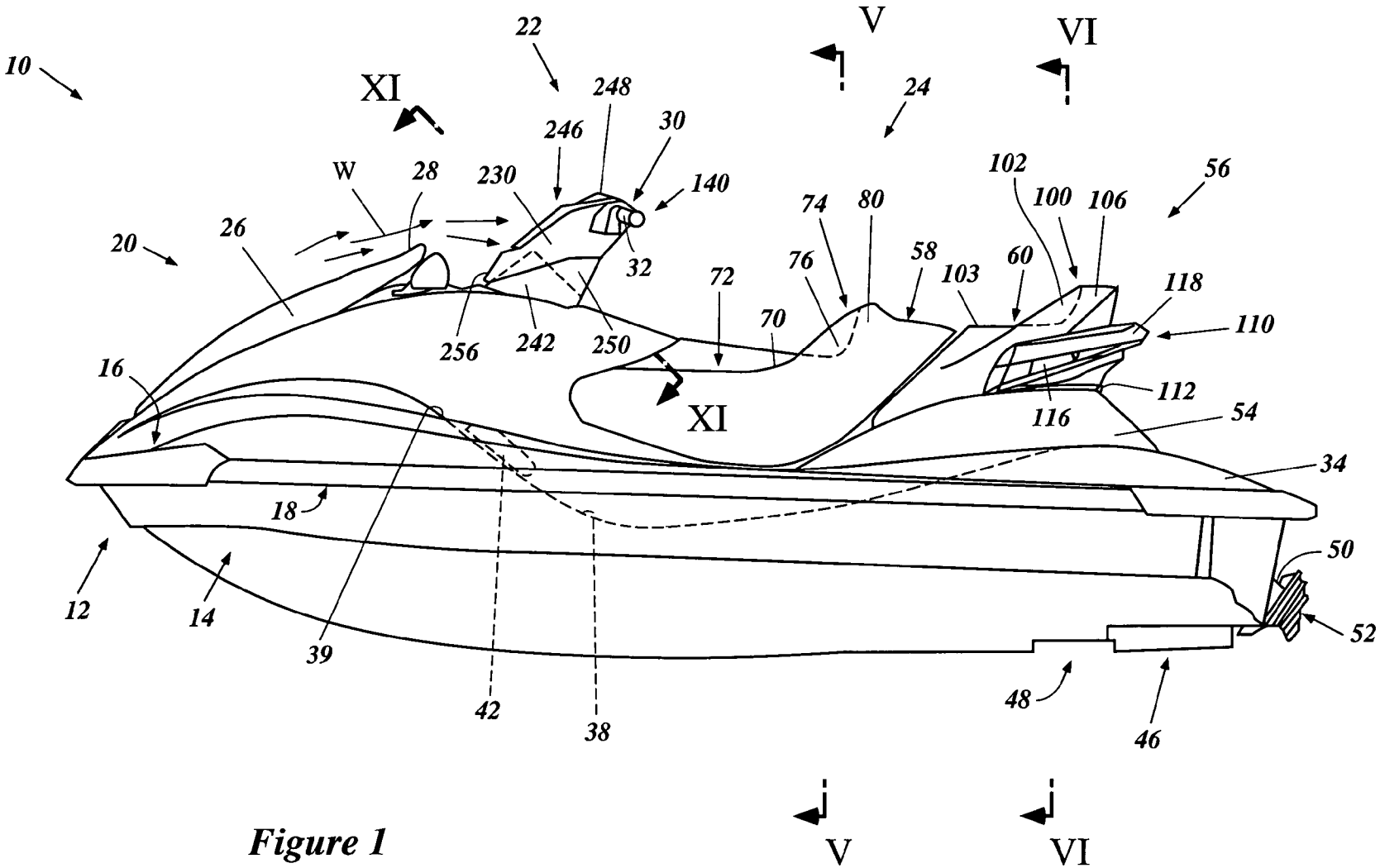
FIG. 1 is a side elevational view of a personal watercraft configured in accordance with an embodiment.
Figure 2:
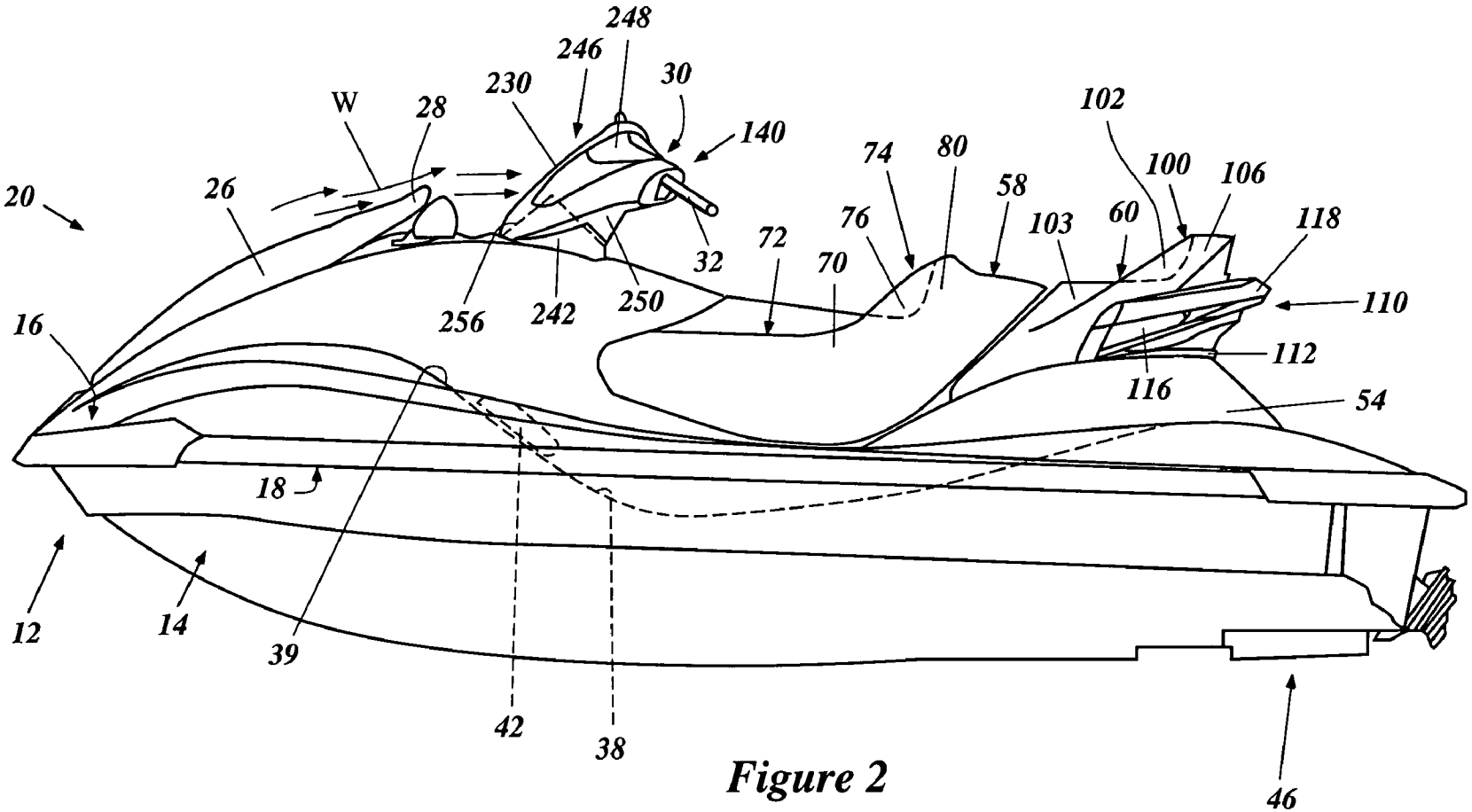
FIG. 2 is a side elevational view of the watercraft illustrated in FIG. 1 with the handlebar turned toward the port side.
Figure 3:
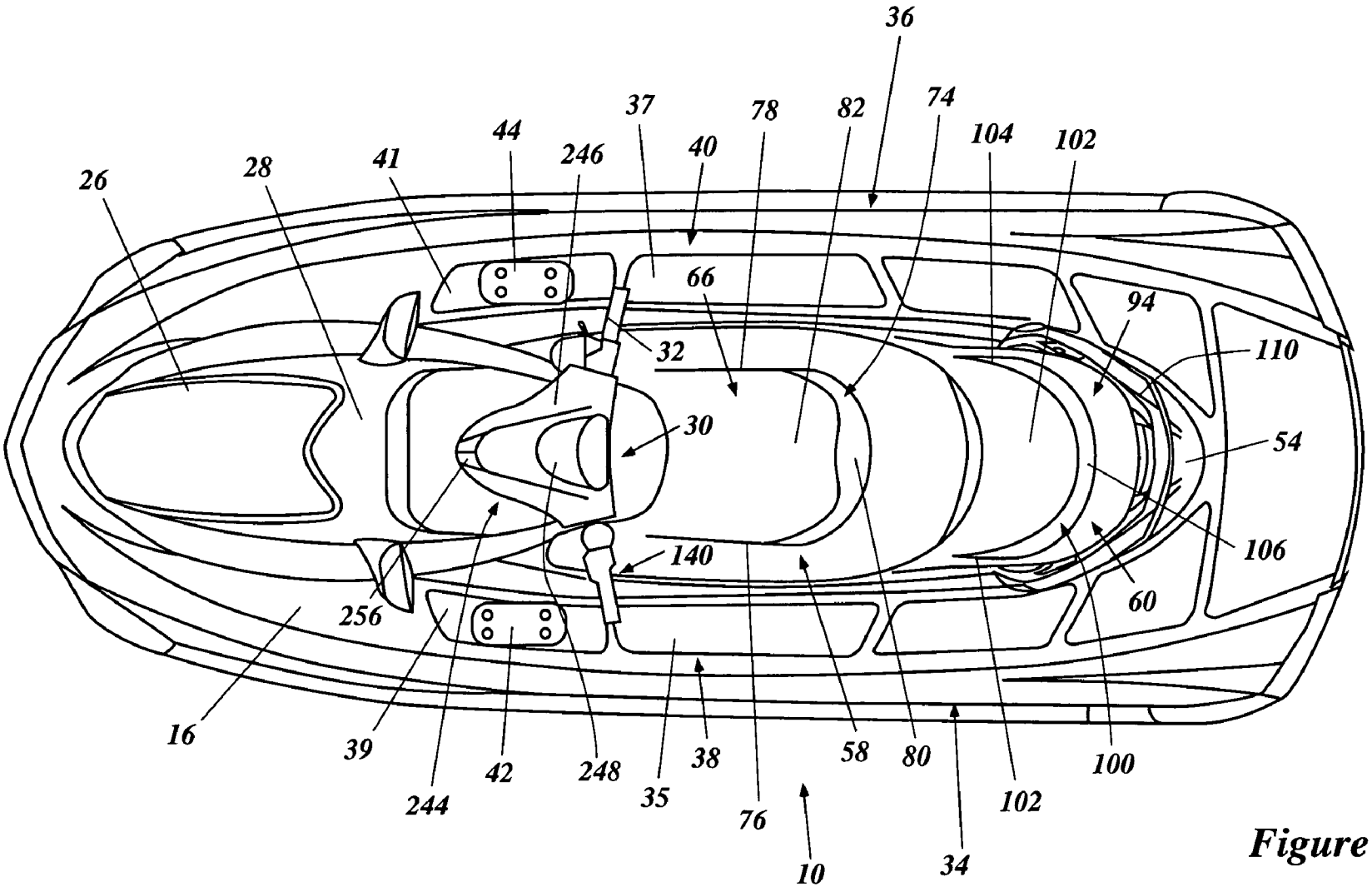
FIG. 3 is a top plan view of the personal watercraft illustrated in FIG. 1.
Figure 4:
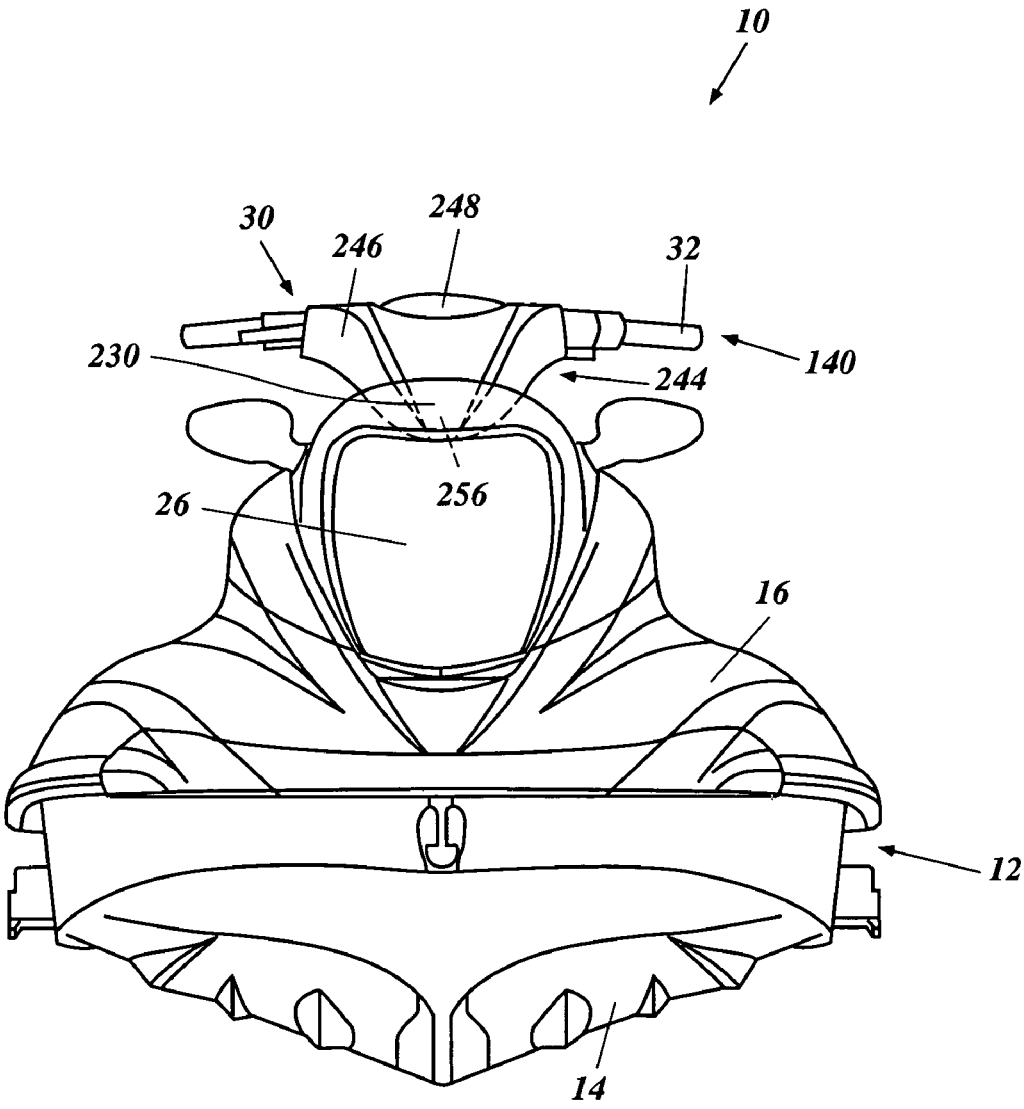
FIG. 4 is a front elevational view of the watercraft illustrated in FIG. 1.

With initial reference to FIG. 1-3, the watercraft 10 includes a hull 12 formed by lower hull section 14 and an upper deck 16. The hull sections 14, 16 are formed from a suitable material such as, for example, a molded fiberglass reinforced resin. However, other materials can also be used. The lower hull section 14 and the upper deck section 16 are fixed to each other around the peripheral edges thereof. For example, the peripheral edges can be bonded together along a bond flange 18.

As viewed in the direction from the bow to the stern of the watercraft 10, the upper deck section 16 includes a bow portion 20, a control mast 22, and a rider's area 24. The bow portion 20 slopes upwardly toward the control mast 22 and includes at least one air duct (not shown) through which air can enter the hull 12.

The upper deck section 16 can include one or a plurality of access openings (not shown). For example, the bow portion 20 can include an access opening formed forwardly from the control mast 22. Such an access opening can allow access into the interior of the hull 12. The portion of the interior of the hull 12 accessed through the aperture in the bow portion 20 can be opened to the entire interior of the hull 12, or can be separated from the remainder of the interior of the hull 12 with a bulkhead (not shown).

Optionally, a removable storage tub can be disposed within the portion of the hull 12 accessible through the aperture in the bow portion 20. The removable storage tub can be disposed completely within the hull 12 or can include a lip so as to allow the storage tub to hang from the peripheral edge of the aperture.

Regardless of the design of the aperture, preferably a hatch 26 is pivotally attached to the bow portion 20. For example, the hatch 26 can be mounted to the upper deck section 16 with a hinge so as to allow the hatch 26 to be pivoted between opened and closed positions. FIG. 1 illustrates a closed position of the hatch 26.

Preferably, the hatch 26 is configured to provide a sealing engagement with the aperture disposed in the bow portion 20. For example the hatch 26 can include a gasket or other devices for sealing against the peripheral edge of the aperture and/or the storage tub noted above. Preferably, a locking mechanism or at least a handle for a locking mechanism (not shown) is disposed in the vicinity of the rearward edge 28 of the hatch 26. Thus, an operator of the watercraft positioned in the rider's area 24 can reach the locking mechanism so as to open the hatch 26.

The rearward edge 28 of the hatch 26 can be configured so as to direct water spray W upwardly during forward movement of the watercraft 10. As such, the hatch 26 can be considered to be a water spray deflection member.

The control mast 22 includes a handlebar assembly 30 disposed rearwardly from the bow portion 22. The handlebar assembly 30 is connected to a steering mechanism (described in more detail below) for use in directing the watercraft 10. The handlebar assembly 30 is generally t-shaped, having a crossbar with opposing handle portions 32. Preferably, a grip is disposed on each of the ends 32 for providing additional comfort for the operator of the watercraft 10.

Numerous watercraft controls can be adjacent to at least one of the ends 32 for use by the operator in controlling the watercraft 10. For example, but without limitation, a throttle lever can be disposed adjacent to one of the grips, so that an operator can actuate the throttle lever with a finger or thumb. Additionally, a switchbox (not shown) can be disposed adjacent to one of the grips. Such a switchbox can include a kill switch and a start switch for use by the operator of the watercraft 10. A lanyard switch (not shown) can also be provided for stopping the engine in the event that the operator falls off the watercraft 10.

The upper deck section 16 of the hull 12 advantageously includes a pair of raised gunnels 34, 36 positioned on opposite sides of the deck assembly 16. The gunnels 34, 36 define a pair of foot areas 38, 40 that extend generally longitudinally along the sides of the upper deck 16. In this position, an operator and any passenger sitting in the rider's area 24, can place their feet in the foot areas 38,40 with the raised gunnels 34, 36 shielding the feet and lower legs of the riders. Preferably, texturized mats 35, 37 cover the foot areas 38, 40.

Preferably, each of the foot areas 38, 40 includes a footrest 42, 44, respectively. An exemplary embodiment of the footrest 42, 44 is described in greater detail below with reference to FIG. 8. The foot rests 42,44 can be positioned at raised portions 39, 41 of the foot areas 38, 40.

With continued reference to FIG. 1, the lower hull section 14 is designed such that the watercraft 10 planes or rides on a small surface area at the aft end of the lower hull 14 in order to optimize the speed and handling of the watercraft 10 when on plane. For this purpose, the lower hull section generally has a v-shaped configuration formed by a pair of inclined section (FIG. 4) that extend outwardly from a keel line of the hull. To the hull's sidewalls, the inclined sections extending along a dead-rise angle. The inclined sections also extend longitudinally from the bow toward the transom of the lower hull 14. The sidewalls are generally flat and straight near the stern of the lower hull 14 and smoothly blend toward the longitudinal center of the watercraft at the bow. The lines of intersection between the inclined sections and the corresponding sidewalls form outer chines of the lower hull section 14. A ride plate 46 can be disposed at a rear portion of the lower hull section 14.

The lower hull section 14 principally defines an engine compartment within the hull 12. Except for the air ducts noted above, the engine compartment is preferably substantially sealed so as to enclose the engine (not shown) from the body of water in which the watercraft 10 is operated.

The engine can be an internal combustion engine for powering the watercraft 10. Preferably, the engine is positioned within the engine compartment and is mounted approximately centrally within the hull 12. Vibration absorbing engine mounts can be used to secure the engine to the lower hull portion 14 in a known manner.

The engine can be any type of engine, such as, for example, but without limitation, any engine that operates on any one of the four-stroke, two-stroke, diesel, or rotary combustion principals. Additionally, the engine can be any size and have any cylinder configuration. Because the internal details of the engine, field supply system, the induction system, and the exhaust system can be of any conventional type, a further description of the engine construction-related system is not believed necessary to understand and practice the inventions disclosed herein.

Preferably, the engine drives a jet propulsion unit (not shown) which is supported by the hull 12 and positioned at the aft and thereof. An intake duct of the jet propulsion unit can include a downwardly facing inlet 48 disposed just forward of the ride plate 46.

The jet pump draws water from the body of water in which the watercraft operates and discharges the water through a steering nozzle 50. The steering nozzle is pivotally mounted at the rear end of the jet propulsion unit and is connected to the handlebar 30 so as to allow an operator of the watercraft to change the angular orientation of the steering nozzle 50 and thereby steer the watercraft 10.

Preferably, the watercraft 10 also includes a reverse bucket 52. A reverse bucket can be pivotably mounted relative to the steering nozzle 50 between opened and closed positions. In the opened position, water from the steering nozzle 50 is directed rearwardly, thereby producing forward thrust for the watercraft. When the reverse bucket 52 is in the closed position (illustrated in FIG. 1), the stream of water discharged through the steering nozzle is redirected in a downward and forward direction, thereby producing reversed thrust for the watercraft 10.

The rider's area 24 is also defined by a seat pedestal 54 which is configured to support a seat assembly 56. The seat pedestal 54 is defined by a centrally raised portion of the upper deck section 16. The pedestal 54 extends generally longitudinally along the rider's area 24. The foot areas 38, 40 are defined between the side walls of the seat pedestal 54 and the gunnels 34, 36, respectively.

The seat pedestal 54 can be formed integrally or monolithically with the upper deck section 16. However, other methods can be used for forming the seat pedestal 54.

With continued reference to FIG. 1, the seat assembly 56 defines a straddle-type seat for an operator and at least one or two passengers. The seat assembly 56 can be made from one or plurality of distinct assemblies.

In the illustrated embodiment, the seat assembly 56 is formed with a forward portion 58 and a rearward portion 60. By dividing the seat assembly 56 into multiple components, e.g., 58, 60, the seat assembly 56 can be more easily removed from the watercraft 10. For example, one or both of the portions 58, 60 can form sealing engagements with apertures defined in the upper portion of the seat pedestal 56. The apertures can provide access to the engine of the watercraft 10 or additional storage bins. Additionally, by dividing the seat assembly 56 into a plurality of portions, the smaller seat portions 58, 60 can be more easily removed from the watercraft 10, i.e., a single piece seat assembly can be heavy.

Figure 5:
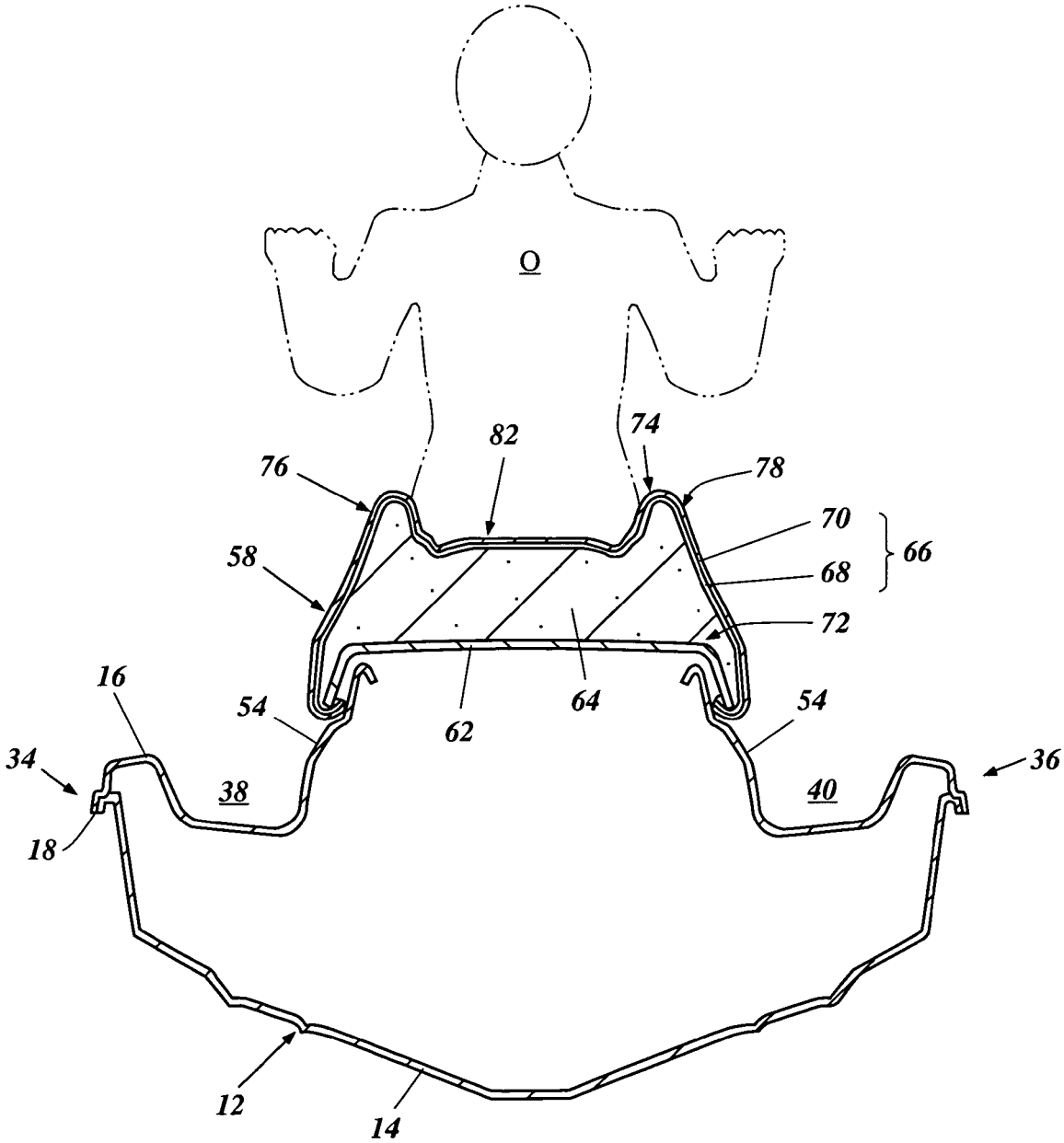
FIG. 5 is a sectional view of the watercraft illustrated in FIG. 1 taken along line V—V of FIG. 1 and with a schematic illustration of an operator of the watercraft in phantom line.

With reference to FIG. 5, the forward portion 58 is comprised of a base member 62, a cushion portion 64, and an outer skin portion 66. The base portion 62 can be formed from a substantially rigid plate-type member, and can be made from any material, including but without limitation, metals and/or plastics. The base member 62 can be flat or contoured. Preferably, the base member 62 provides the overall structural rigidity for the seat portion 58.

The cushion portion 64 can be made from any type of cushion material. For example, but without limitation, the cushion portion 64 can be made from polyurethane foam. The cushion portion 64 extends over the base member 62. Additionally, the cushion portion 64 can be bonded to the base members 62, or connected with other means.

The outer skin 66 of the seat portion 58 can be made from any material or in any known manner. In the illustrated embodiment, the outer skin includes an intermediate layer 68 and an outer skin layer 70. The intermediate layer 68 preferably is bonded to and covers the outer surface of the cushion portion 64. The outer skin 70 preferably is bonded to the intermediate layer as well and covers the intermediate layer 60. The outer skin 70 preferably has a leather-like finish and is stitched with threads. The intermediate layer 68 prevents water from entering the cushion portion 64 through the hulls associated with the stitched threads. Together, the cushion portion 64 and the skin 66 define a body 72 of the seat portion 58.

A further advantage is provided where the seat portion 58 includes a generally U-shaped raised portion 74 (FIGS. 5 and 3). The raised portion 74 includes raised lateral portions 76, 78 (FIG. 5) and a rear raised portion 80 (FIG. 3). The raised portion 74 extends around a central seating portion 82. The relative height of the raised portion 74 to the central portion 82 is sized so as to extend up to about the hips of a rider of the watercraft 10. In the illustrated embodiment, the watercraft 10 is designed to be operated by an operator O (FIG. 5) that is sufficiently tall such that such an operator O can stand above the seat portion 58 with the operator's feet in the foot portions 38, 40. In an exemplary but non-limiting embodiment, the watercraft 10 is sized to be ridden by an operator O that is at least about 4 ft. tall. Typically, a human that is at least 4 ft. tall has legs that are sufficiently long that such a rider can stand with their feet in the foot areas 38, 40 and above the seating area 82. Additionally, the raised area 74 is sufficiently low that an operator or rider with such a minimum height can step over the rear portion of the raised portions 74 when boarding the watercraft 10 from the rear.

For example, occasionally, operators or riders for watercraft 10 will swim in the water in which the watercraft 10 is floating. When returning to the watercraft 10, such riders or operators can re-board the watercraft 10 from the aft end thereof. For example, the rider can climb up on the rear portion of the deck section 16 behind the rider's area 24 and then walk over the seat assembly 56 to reach the desired seating position. Thus, a further advantage is provided where the rear area 80 of the raised portion 74 is sufficiently low that a rider of the above-noted minimum height can step over the rear portion 80 when re-boarding the watercraft 10 from the aft end thereof.

Figure 6:
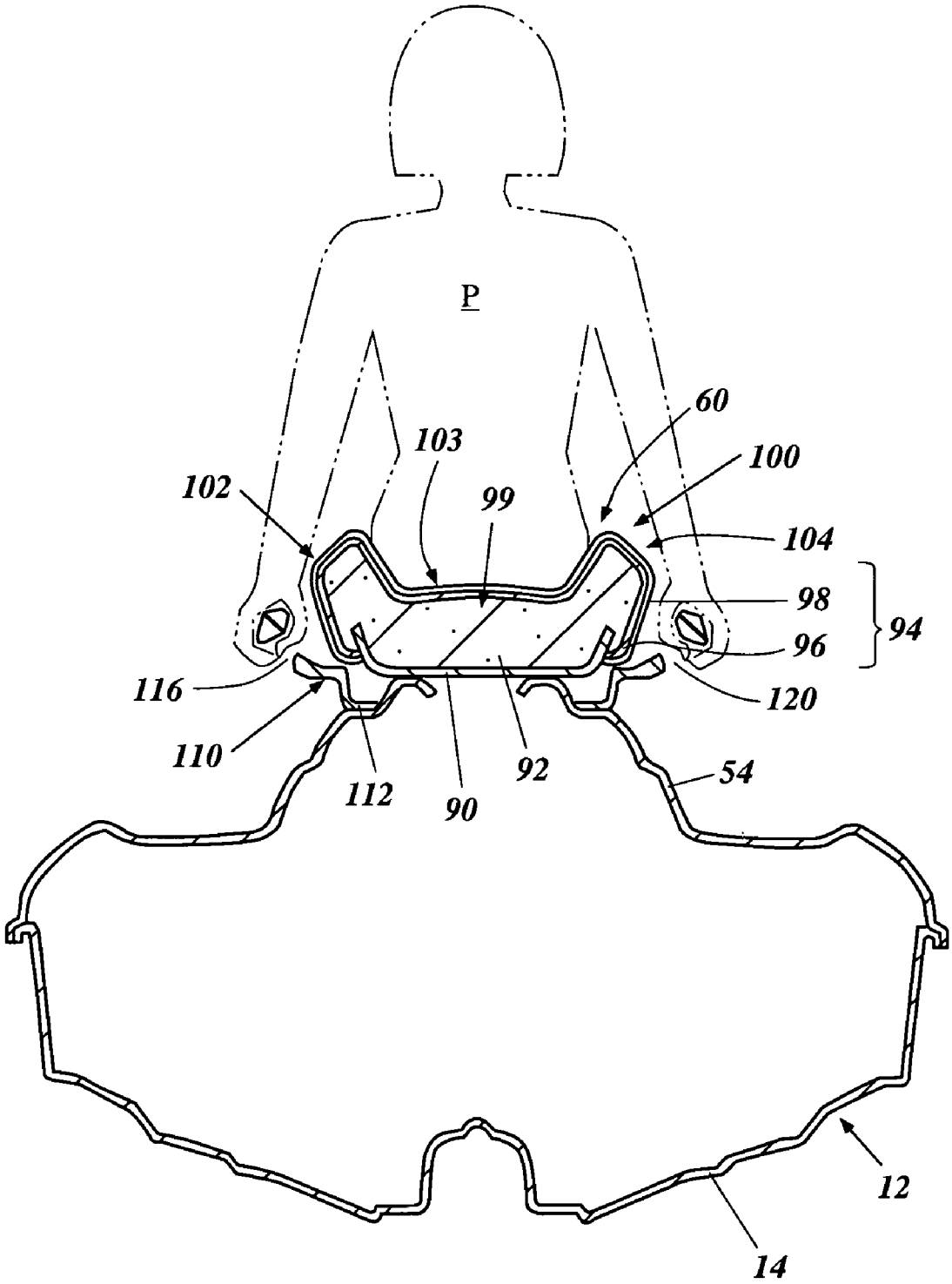
FIG. 6 is a sectional view of the watercraft illustrated in FIG. 1, taken along line VI—VI with a schematic representation of a passenger of the watercraft shown in phantom line.
Figure 7:
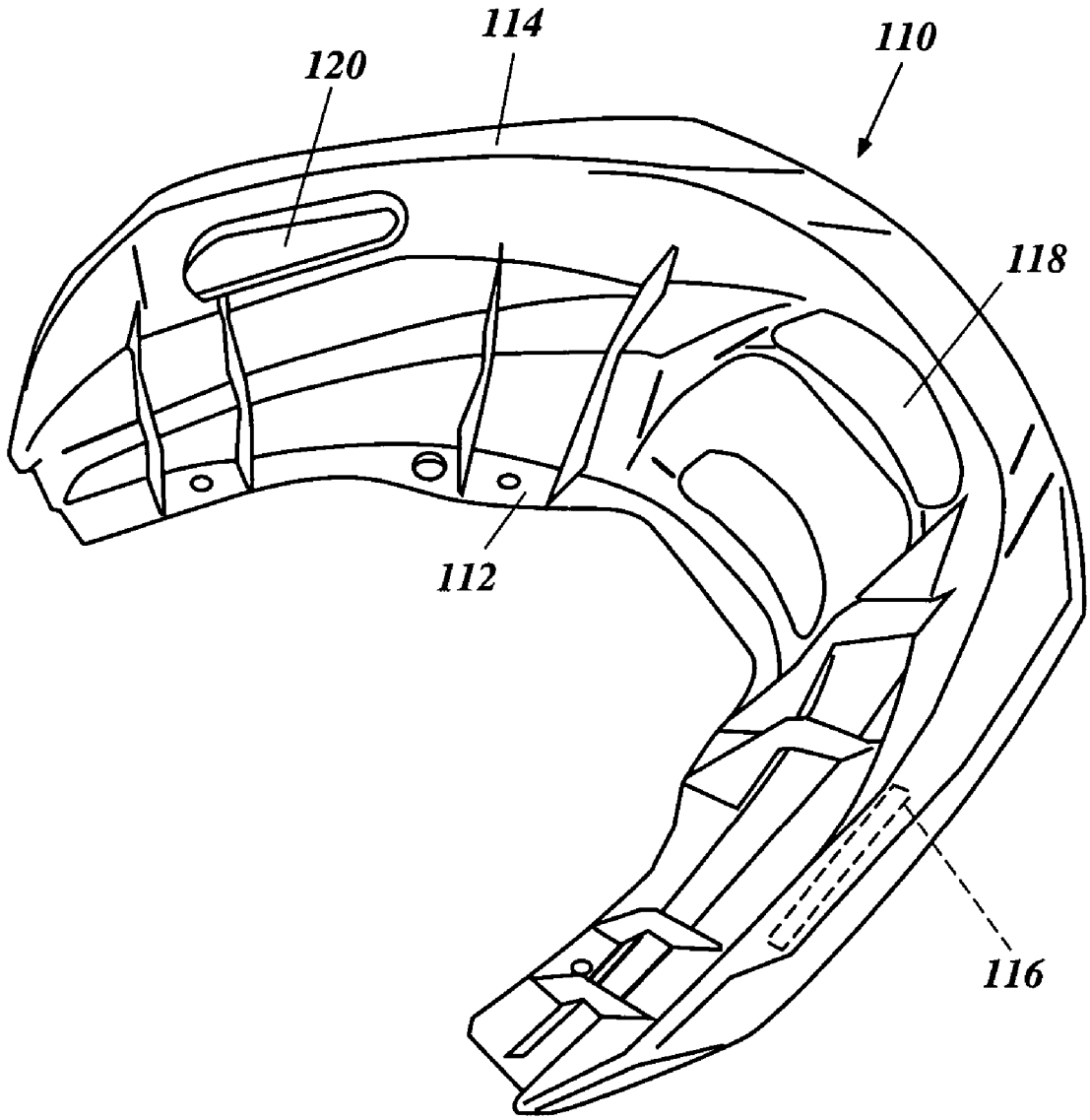
FIG. 7 is a top, front, and port side perspective view of a handgrip removed from the watercraft illustrated in FIG. 1.

With reference to FIG. 6, the rear seat section 60 is constructed similarly to the front seat section 58. The rear section 60 can include a base member 90, a cushion portion 92 and an outer skin 94.

The base member 90 can be a substantially rigid member made from any material. The cushion portion 92 can be made from a polyurethane form or another material. The skin 94 can be made from any material. Preferably, the skin 94 includes an intermediate layer 96 that is bonded to and covers the surface of the cushion portion 92. An outer skin layer 98 can be used to cover the intermediate layer 96.

The outer skin layer 98 can be made from any material and preferably has a leather-like finish. Additionally, the outer skin 98 can be made from a single piece of material or can be made from individual panels stitched together. Of course, the stitching can be added to a single piece of material to provide the appearance of a stitched, leather-like seating surface. As such, the intermediate layer 96 prevents water intrusion into the cushion portion 92 through the holes associated with the stitching. Together, the cushion portion 92 and the skin 94 define a body 99 of the seat section 60.

Similarly to the forward seat section 58, the rear seat section 60 includes a raised portion 100. The raised portion 100 can be generally U-shaped and extend around at least a portion of a central seating portion 102.

The raised portion 900 includes lateral raised portions 102, 104 and a rear raised portion 106 (FIG. 3). The relative height of the raised portion 100 relative to the seating portion 102 can be about the same as that described above with reference to the raised portion 74 of the front seat portion 58.

The shapes of the raised portions 74, 100 provide enhanced comfort for a rider, such as an operator O or a passenger P of the vehicle with a straddle-type seat. As used herein, the term "rider" of a watercraft is intended to include an operator O or passenger P.

Typically, the prior art straddle-type seats used on personal watercraft do not include hip support portions. Rather, straddle-type seats are generally saddle-shaped and do not include any types of bolsters or supports in the vicinity of the hips of a rider. However, it has been found that providing support for the hips of a rider of such a vehicle provides enhanced comfort and can reduce muscle fatigue in various parts of the body. Additionally, the lateral portions 76, 78, 102, 104 help to guide a rider to a centered position on the seats 58, 60.

With reference to FIGS. 1, 3 and 6, the seating assembly 56 also includes a grab handle assembly 110. The grab handle assembly 110 is illustrated in prospective view removed from the watercraft 10.

As shown in FIG. 6, the grab handle assembly 110 is generally U-shaped and includes a mounting portion 112 and a handle portion 114. The mounting portion 112 is configured to provide a structure for attachment to the seat pedestal 54 of the watercraft 10. The mounting portion 112 can be configured in any manner. In the illustrated embodiment, the mounting portion 112 includes a flange extending along the inner periphery of the assembly 110. Additionally, a plurality of holes can be disposed along the flange of the mounting portion 112 for mounting to the seat pedestal 54. Of course, any type of fastening means can be used to connect the assembly 110 to the deck section 16 of the watercraft 10 including, for example, but without limitation, bonding, rivets, threaded fasteners, etc.

Preferably, the handle portion 114 of the assembly 110 defines a plurality of handles oriented such that a passenger P of the watercraft 10 can grasp at least one of the handles while seated on the rear seat section 60. In the illustrated embodiment, the handle portion 114 includes a plurality of apertures 116, 118, 120 configured to define handles that are graspable by human hand. The apertures 116, 120 are defined on lateral sides of the assembly 110. Additionally, the apertures 116, 120 preferably are arranged such that the handles defined by such apertures are positioned to be grasped by a passenger P seated on the rear seat section 60.

Thus, as shown in FIG. 6, the rear seat section 60 is disposed within a portion of the assembly 110. In other words, the sidewalls of the assembly 110 extend upwardly above the bottom surfaces of the rear seats section 60. Additionally, the sidewalls of the assembly 110 extend outwardly around the outer side of the rear seat section 60. Thus, a sufficient clearance is provided between the handles defined by the apertures 116, 120 and these outer sidewalls of the rear seat section 60 so as to allow a passenger P to comfortably grasp the handles defined by the apertures 116, 120 while seated on the rear seat section 60 and during the operation of the watercraft 10.

The aperture 118 at the rearward end of the assembly 110 can define another handle. For example, such a handle can be used by a rider of the watercraft 10 when re-boarding the watercraft from the aft end thereof. For example, as a rider climbs out of the water in which the watercraft 10 is floating and on to the aft end of the watercraft 10, the handle defined by the aperture 118 can be conveniently located such that it can be grasped by the rider during such a re-boarding procedure.

Figure 8:
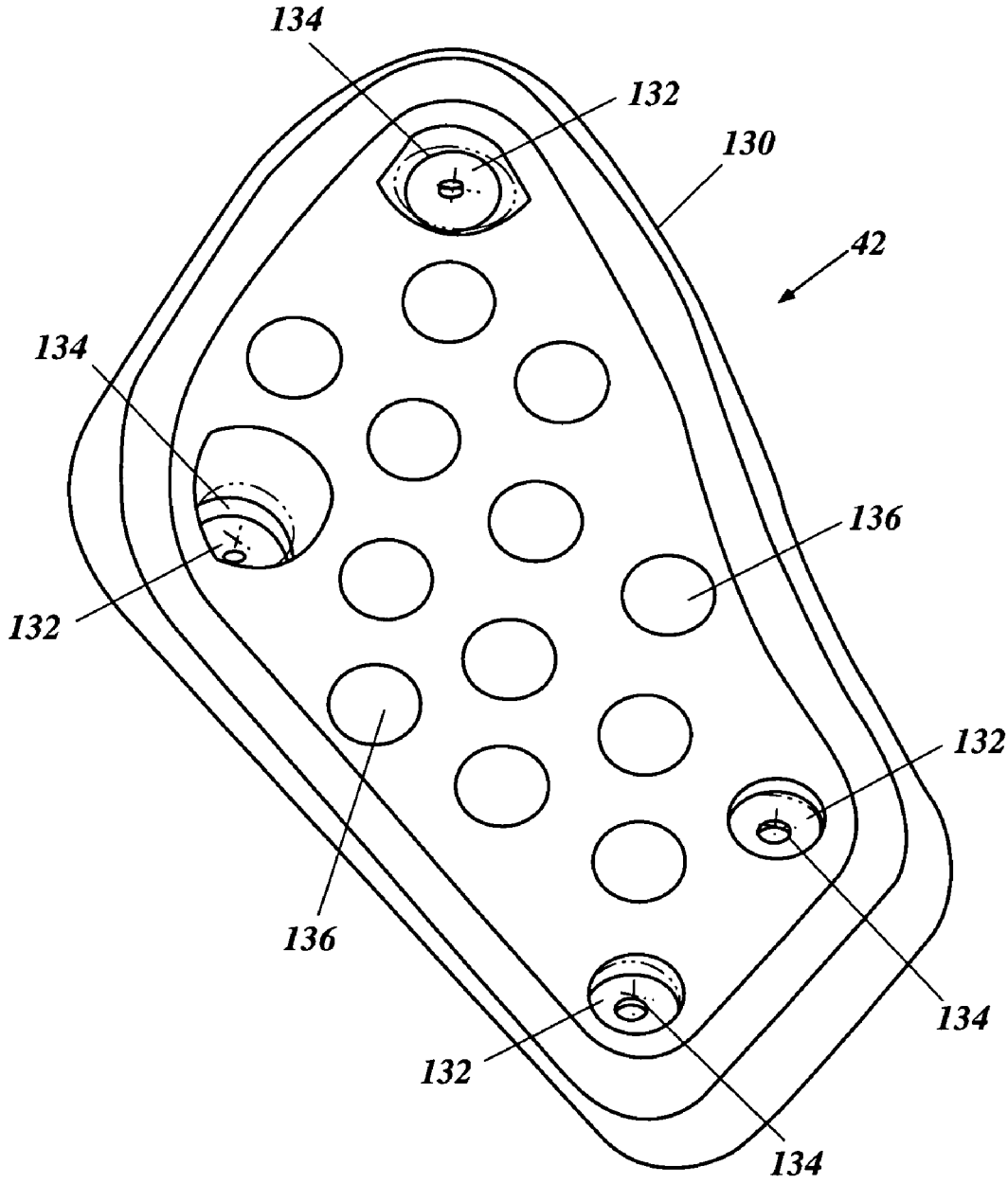
FIG. 8 is a top plan view of a footrest disposed in a foot well of the watercraft of FIG. 1, illustrated as being removed from the watercraft.

With reference to FIG. 8, the foot rests 42, 44 can have any shape. The foot rest 42 illustrated in FIG. 8 includes a body member 130 that is generally rectangular in shape. The body 130 includes four recesses 132 on its upper surface. Additionally, apertures extend through the body 130 within the aperture recesses 132.

The recesses 132 and corresponding apertures can be used for mounting the foot rest 42 to the upper deck section 16. For example, fasteners 134 can be disposed through the apertures to secure the foot rest 42 to the upper deck section 16. As such, the fasteners 134 can be recessed away from or approximately flushed with the upper surface of the foot rest 42. Any type of fastener can be used, for example, but without limitation, rivets, bolts, screws, etc.

The foot rest 142 also includes contours configured to provide texture to the upper foot rest 42, so as to allow a user to rest their feet on the foot rest 42 during operation of the watercraft 10. The contours 136 can be in any configuration. For example, the contours 136 can be in a form of a sandpaper-like texture or any other texture that can provide a skid-resistant surface. In the illustrated embodiment, the contours 136 are in a form of hemispherical mounds disposed on the upwardly facing surface of the foot rest 42. The foot rest 44 can be constructed in accordance with the description set forth above with respect to the foot rest 42.

Figure 9:
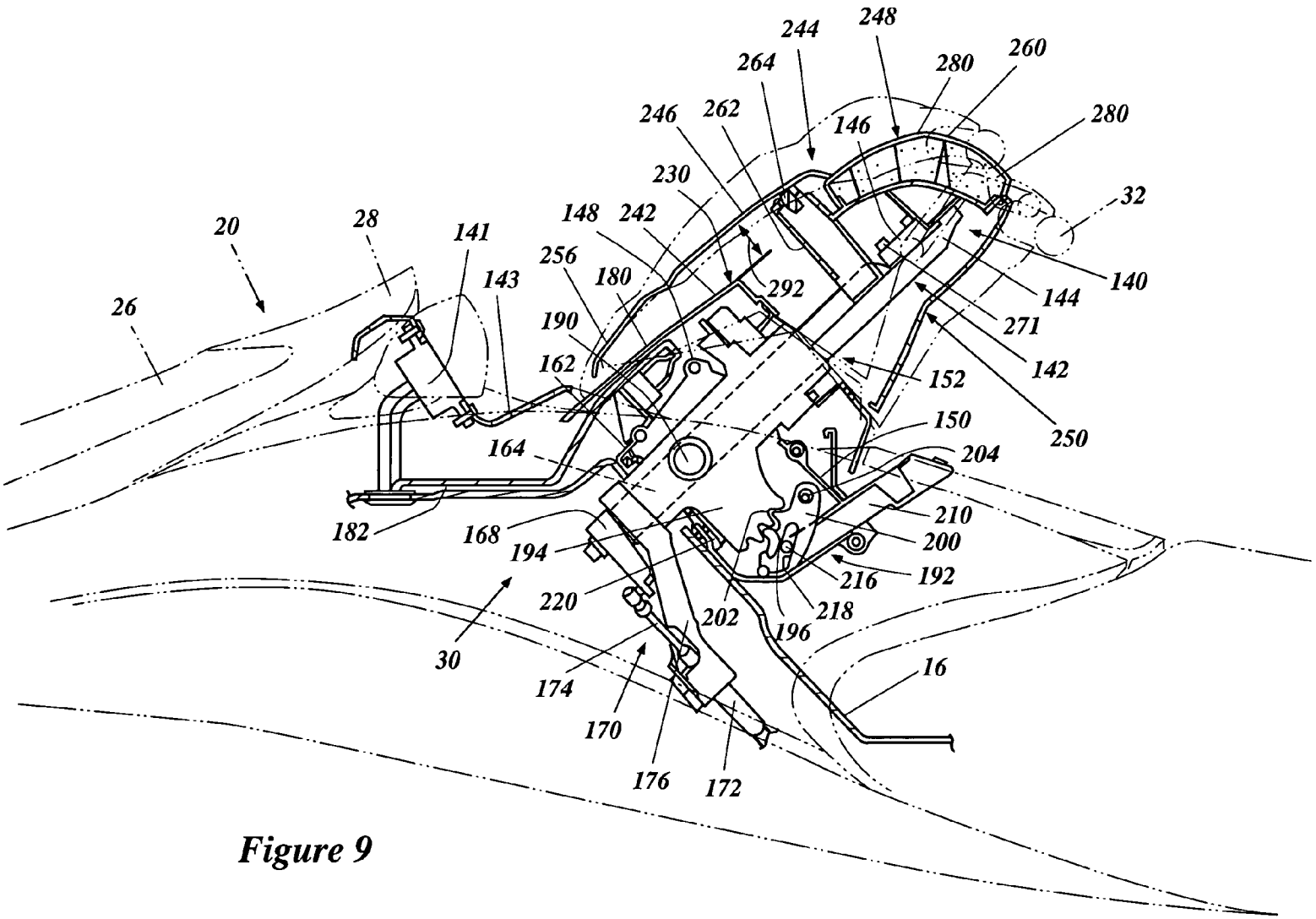
FIG. 9 is a partial sectional view of a steering assembly of the watercraft of FIG. 1.
Figure 10:
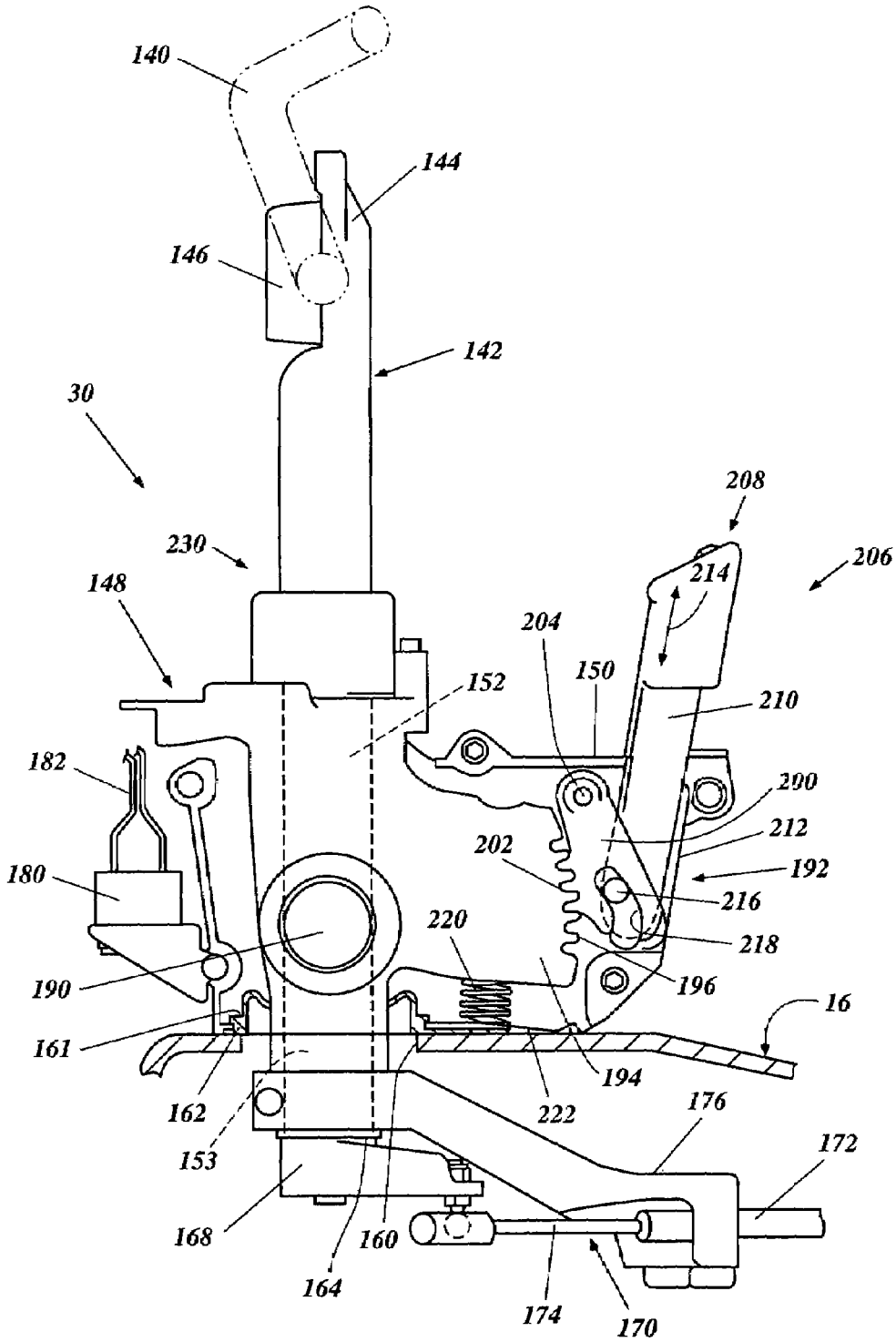
FIG. 10 is an enlarged illustration of the steering assembly illustrated in FIG. 9 with the cover members removed.

With reference to FIGS. 9 and 10, the handlebar assembly 30 is configured to allow the inclination of the handlebars to be changed, which is commonly referred to as "tilt steering". The specific tilt steering mechanism disclosed herein is merely one exemplary type of tilt steering system or mechanism that can be used in the watercraft 10. Other tilt steering systems can also be used.

With continued reference to FIG. 9, the handlebar assembly 30 includes a handlebar 140 mounted to a handlebar shaft 142. The handlebar 140 can be attached to the handlebar shaft 142 with any type of connector or mounting method. A clamp (not shown) can be used to secure and thereby fix the position of the handlebar 140 relative to the shaft 142. As shown on FIG. 10, the handlebar 140 is mounted to an upper end 144 of the shaft 142. Preferably, a mounting boss 146 is also disposed at the upper end 144 of the shaft 142. The mounting boss 146 preferably is configured to provide a mounting surface for covers for the steering assembly 30, described in greater detail below.

One or a plurality of gauges or meters can be disposed forwardly or rearwardly from the handle bar assembly 30. For example, in the illustrated embodiment, the watercraft 10 includes a display 141 mounted on a gauge panel 143. The display 141 can be any type of analog or digital gauge, such as, for example, but without limitation, tachometer, speedometer, oil pressure, oil level, fuel level, battery status, etc. The display 141 can be a dedicated display, i.e., configured to display only one kind of information, or it can be configured to display any combination or all information available to the rider's of the watercraft 10. Additionally, the display can be configured t operate as a user interface for allowing a user of the watercraft 10 to browse through a plurality of menus of information, and thus, can include one or a plurality of buttons fur such operations. Such buttons can be disposed on the display, the handlebar assembly 30, the panel 143, or any other location on the watercraft 10.

The steering shaft 142 is supported by a post assembly 148. The post assembly 148 includes a housing 150 which rotatably supports a steering post 152. For example, the housing 150 can include one or plurality of bearings (not shown) for supporting the post 152. Additionally, the shaft 142 is rotatably secured to the post 152. However, it is to be noted that the steering shaft 142 and the post 152 can be made from one or plurality of separate shafts connected together. A lower end 153 of the post 152 extends through the deck section 16.

The housing 150 is also secured to the upper deck section 16 of the watercraft 10. The housing 150 can be secured on the exterior or the interior of the hull 12. In the illustrated embodiment, the housing 150 is mounted to the exterior of the upper deck section 16 and includes a lower aperture 161.

As shown in FIG. 10, the upper deck section 16 includes a steering assembly aperture 160, through which a portion of the steering assembly 30 extends. Preferably, a seal 162 provides a substantially watertight sealing engagement with a portion of the steering assembly 30 that passes through the aperture 160. In the illustrated embodiment, the seal 162 defines a seal between the aperture 160 and the portion of the steering shaft 148 that extends through the aperture 160. The aperture 160 is larger than the outer dimension of the steering shaft section 148. This allows the steering shaft 148 to move relative to the aperture 160, for example, when the steering assembly 30 is tilted about a tilt axis, described in greater detail below. Further, the seal 162 is configured to accommodate the relative movement of the steering shaft section 148 relative to the aperture 160. Thus, the seal 162 can comprise a thin wall boot-type design. Other types of seals can also be used.

An oscillating member 168 is connected to the lower end 164 of the shaft 142. The oscillating member 168, at its distal end, is connected to a steering cable assembly 170.

The steering cable assembly 170 includes an outer housing portion 172 and an inner cable portion 174. The outer housing portion 172 is fixed relative to the post section 148 with a bracket member 176. The inner cable 174 can slide relative to the housing portion 172.

Thus, when the handlebars 140 are turned, the pivot member or oscillating member 168 rotates about its axis and causes the inner cable 174 to extend from and retract into the outer housing 172. Additionally, because the bracket member 176 fixes the position of the outer housing 172 relative to the post section 148, the steering assembly 30 can be tilted (described in greater detail below) without affecting the interaction of the oscillating member 168 and the cable assembly 170.

The watercraft 10 can also include a buzzer mechanism 180 configured to emit a buzzing sound. For example, the buzzing sound emitted from the buzzer device 180 can be actuated when the watercraft is low on fuel or other situations. The buzzer device 180 can be connected to a control device such as an ECU (not shown) for controlling its actuation.

Figure 11:
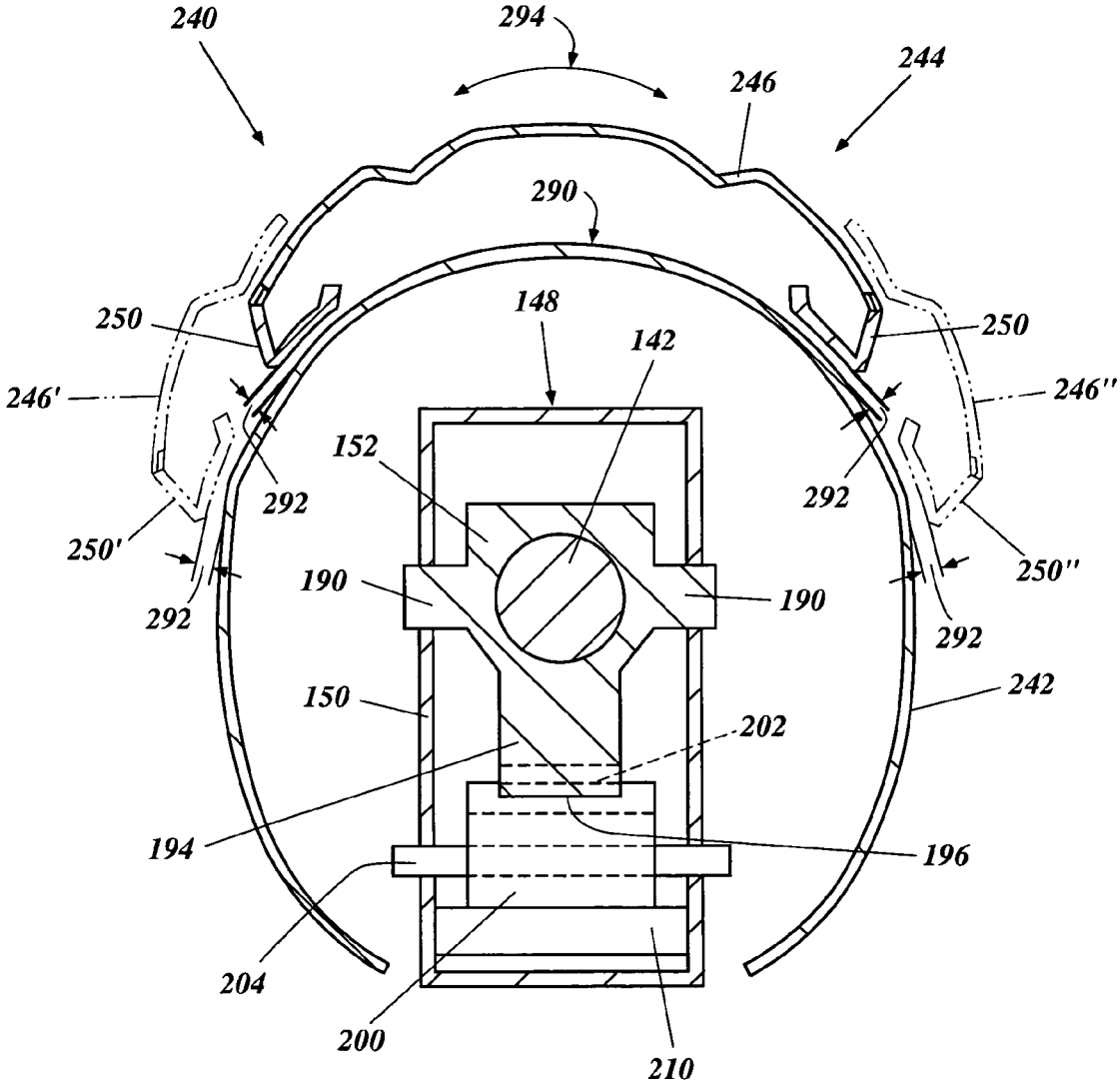
FIG. 11 is a sectional view of the steering assembly illustrated in FIG. 9 taken along the line X—X of FIG. 1.

With continued reference to FIG. 10, the steering assembly 30 is tiltable about an axis defined by a post section pivot 190. As shown in FIG. 11, the post section pivot 190 can include left and right portions disposed on diametrically opposite sides of the steering shaft 142. The post section pivot 190 can be supported by the housing 150.

For example, the housing 150 can include apertures configured to receive portions of the post section pivot 190. Additionally, the apertures in the housing 150 can include bearings (not shown). Additionally, as noted above, the steering shaft 142 can rotate within the post assembly 152. Thus, the steering assembly including the handlebars 140 and steering shaft 142, can pivot about an axis defined by the post section pivot 190. Thus, the handlebars 140 can be moved toward and away from a rider of the watercraft 10 as shown by the two positions of the handlebar 140 illustrated in phantom line in FIG. 9.

Preferably, the watercraft 10 also includes a tilt lock assembly 192 configured to allow the angular position of the steering assembly 30 to be fixed in a plurality of positions. A lock mechanism 192 can incorporate any type of locking design.

In the illustrated embodiment, the lock mechanism 192 cooperates with a gear section 194 disposed on the post assembly 148. The gear section 194 extends radially away from the steering shaft 142. A plurality of teeth 196 are arranged along an outer surface of the gear section 194. The teeth 196 are arranged in an arch along the radius of curvature centered about the pivot axis defined by the pivots 190.

With continued reference to FIG. 10, the lock mechanism 192 also includes an engagement lever 200. the engagement lever 200 is configured to move into and out of engagement with the gear section 194. In the illustrated embodiment, the engagement lever 200 includes a plurality of teeth 202 which are configured to engage with the teeth 196 of the gear section 194. The teeth 202 preferably are also arranged along a radius of curvature centered about the pivot axis defined by the pivots 190. Thus, when the engagement lever 200 is moved towards the gear section 194, a plurality of the teeth 202 can engage with a plurality of the teeth 196.

The engagement lever 200 can be mounted in any known manner to allow the lever 200 to move toward and away from the gear section 194. In the illustrated embodiment, the engagement lever 200 is mounted to be pivotable about an axis 204. The axis 204 can be defined by a pivot pin or a fastener such as a bolt or other device extending through an aperture of the engagement lever 200. Thus, the engagement lever 200 can pivot about the axis 204.

Preferably, the locking mechanism 192 includes a user-operable actuator mechanism 206 that is configured to allow a rider of the watercraft 10 to lock and unlock the locking mechanism 192. For example, the actuator mechanism 206 can be configured to move the engaging lever 200 toward and away from the gear section 194.

In the illustrated embodiment, the actuator 206 comprises a handle 208 connected to a control shaft 210. The handle 208 preferably is configured so that a rider of the watercraft 10 can grasp the handle 208 so as to move the control shaft 210 between locked and unlocked positions.

In the illustrated embodiment, the housing 150 includes a guide 212 configured to allow the control shaft 210 to be moved along an axial direction identified by the reference numeral 214. A pin 216 is mounted near a lower end of the control shaft 210. The pin 216 is configured to engage the engaging lever 200 so as to move the lever 200 between the unlocked and locked positions. The lever 200 can include a guide groove 218 that is shaped such that when the control shaft is moved upwardly (as viewed in FIG. 10), the pin 216 moves outwardly along the groove 218 and thus draws the engaging lever 200 away from the gear section 194 such that the teeth 202 disengage from the teeth 196. With the actuator 206 in such a position, the locking mechanism 192 is unlocked thereby allowing the steering assembly 30 to pivot about an axis defined by the pivot 190.

Preferably, the steering assembly 30 is biased toward an upward or forward position. For example, the steering assembly 30 can include a spring 220 configured to bias the steering assembly toward a fully forward position. Optionally, the spring 220 can be configured to bias the steering assembly 30 towards a lowered position. In the illustrated embodiment, the spring 220 acts against a lower surface of the gear section 194 and a lower wall 222 of the housing 150.

As noted above, the locking mechanism 192 and the specific structure for allowing the steering assembly 30 to pivot about the pivot 190 is merely one example configuration that can be used. Other types of tilt steering and locking mechanisms can also be used.

With reference to FIG. 10, the area identified generally by the reference numeral 230 in the vicinity of the connection between the steering shaft 142 and the post section 148 creates a challenge in preventing water from entering this area of the steering assembly 30. For example, known watercraft typically have cover assemblies for the handlebars which include a stationary portion and a rotatable portion. In order to allow the rotatable portion to rotate freely relative to the fixed portion, a clearance is provided therebetween.

Figure 12:
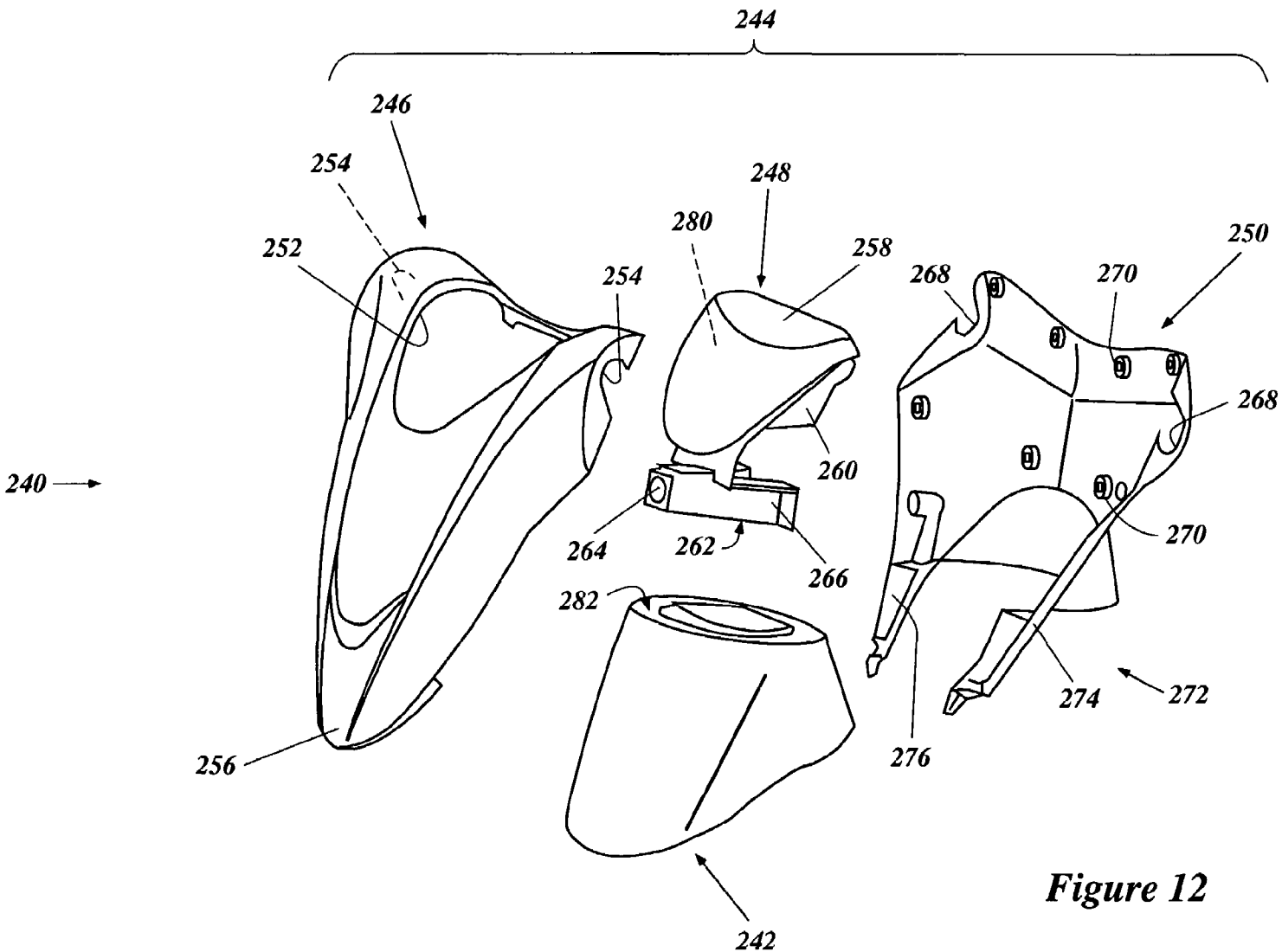
FIG. 12 is an exploded view of the covers of the steering assembly.

As noted above, an aspect of at least one of the inventions disclosed herein includes the realization that the division between the fixed portion and rotatable portion can be modified so as to inhibit water, and in particular water spray, from entering this area. For example, FIG. 12 includes an exploded illustration of a cover assembly 240 for the steering assembly 30 of the watercraft 10. The assembly 240 includes a post cover portion 242 and a handlebar cover portion 244. The handlebar portion 244 includes a front portion 246 and an intermediate portion 248 and a rear portion 250.

When assembled, the handlebar portion 244 covers the handlebar 140 as well as a portion of the shaft 142 and can rotate relative to the post cover portion 242 about the steering axis defined by the steering shaft 142. Thus, the post cover portion 242 can be considered to be fixed relative to the handlebar cover portion 244. However, as described in greater detail below, because the post cover 242 is mounted to the post section 148, the post cover 242 pivots with the post section 148 about the pivot 190.

The front portion 246 of the handlebar cover 244 includes an aperture 252 configured to receive the intermediate cover 248. Additionally, the front portion 246 includes handlebar slots 254 for receiving a portion of the ends of the handlebar 140. A lower end 256 of the front cover portion 246 extends downwardly from the aperture 252.

The intermediate portion 248 includes an upper cover portion 258 and a lower cover portion 260. The intermediate portion 248 also includes a stay 262 having a forward portion 264 and a rearward portion 266.

The rear portion 250 of the handlebar cover 244 includes handlebar slots 268 configured to be aligned with the slots 254 of the front cover portion 246. Additionally, the rear portion 250 includes a plurality of mounting bosses 270 disposed on an inner surface of the rear cover 250.

The mounting bosses 270 include apertures and can be attached to the mounting boss 146 (FIG. 10) with a fastener 271 (FIG. 9) such as a bolt. Additionally, the lower end 272 of the rear cover member 250 is generally u-shaped and includes left and right leg portions 274, 276.

The left and right leg portions 274, 276 are configured to engage with left and right portions of the lower end 256 of the front cover 246. When assembled, the stay 262 of the center of intermediate portion 248 engages with the inner surfaces of both the front and rear cover members 246, 250. Additionally, the intermediate portion 248 is received within the aperture 252 of the front cover member 246. Preferably, a cushion material 280 is provided within the intermediate cover member 248.

In the illustrated embodiment, an upper surface 282 of the post cover member 242 is disposed in the area 230 (FIG. 10). Additionally, when the handlebar cover 244 is assembled, the front and rear cover members 246, 250 extend around the post cover member 242 and extend downwardly from the upper surface 282. As such, the post cover 242 is partially nested within the handlebar cover 244. As such, the area 230 is better protected from water spray that can be generated during operation of the watercraft.

A further advantage is provided where the lower portion 256 of the front cover 246 extends downwardly to a greater degree than the remaining portion of the handlebar cover 244. This provides further protection against water spray that can be generated during operation of the watercraft 10.

With reference to FIG. 11, a further advantage is provided where a forward facing surface 290 of the post cover 242 is defined by a radius of curvature having its center about the steering axis defined by the steering shaft 142. For example, the forward facing surface 290 can extend along a radius extending from the steering axis, defined by the shaft 142, to the outer surface 290. Thus, as the handlebar cover assembly 244 is rotated, the front cover member 246 and the rear cover member 250 also rotate about the steering axis defined by the shaft 142. Thus, a clearance identified generally by the reference numeral 292, can remain generally constant as the handlebar 140 is rotated between the maximum turning positions.

For example, as the handlebar 140 is rotated towards the left and right directions along the direction identified by the arrow 294 (FIG. 11) the handlebar reaches left and right maximum positions identified in phantom line. A portion of the front and rear cover members 246, 250 are illustrated in phantom illustrating the maximum left position 246', 250' and the maximum right position 246", 250". As shown in FIG. 11, the clearance 292 is substantially constant throughout the rotation of the handlebar cover 244. This provides a further advantage in that water spray is prevented from entering the handlebar assembly 30 and in particular the area 230 (FIG. 10).

Other designs for the illustrated and above-described embodiments of the cover members 246, 250 can also be used. For example, covers or other members that are attached to the handlebar assembly 30, the upper deck section 16, the hatch 26, and/or any other part of the watercraft 10 can also be used.

With reference to FIG. 1, another further advantage is provided where the lower end of the handlebar cover 244 extends below a rear end 28 of the hatch cover 26. For example, in the illustrated embodiment, the lower end 256 of the front cover member 246 is disposed lower than the rear end 28 of the hatch cover 26. As such when water spray identified generally by the letter W flows over the bow portion 20 of the hull 12, it is less likely that the water spray W can flow underneath the lower end 256. As such, the cover assembly 240 better protects the steering assembly 30 from water intrusion. FIG. 2 illustrates this relationship with the handlebar assembly 30 turned toward the left or "port" side.

Although the present inventions have been described in terms of a certain preferred embodiments; other embodiments apparent to those of ordinary skill in the art also are within the scope of these inventions. Thus, various changes and modifications may be made without departing from the spirit and scope of the inventions. For instance, not all of the features, aspects and advantages are necessarily required to practice the present inventions. Accordingly, the scope of at least some of the present inventions is intended to be defined only by the claims that follow.

What is claimed is:

1. A steering assembly for watercraft having a hull, the steering assembly comprising a steering post section supported by the hull of the watercraft and a steering handle section being rotatable relative to the steering post section about a steering axis, and a cover member connected to the steering handle section and extending from the steering handle section toward the steering post section so as to extend over a boundary between the steering post section and the steering handle section.

2. The steering assembly according to claim 1, wherein the boundary is defined by a clearance between an upper surface of the steering post section and a lower portion of the steering handle section.

3. The steering assembly according to claim 1, wherein the boundary extends generally along a plane extending generally normal to the steering axis and between the steering handle section and the steering post section.

4. The steering assembly according to claim 1, wherein the steering handle section is configured to provide a steering control output for steering the watercraft when the steering handle section is rotated about the steering axis.

5. The steering assembly according to claim 1, wherein the steering post section includes a forwardly facing surface, the cover member extending downwardly from the steering handle section and over at least a portion of the forwardly facing surface of the steering post section.

6. The steering assembly according to claim 1, wherein the steering post section is at least partially nested with the cover member.

7. The steering assembly according to claim 1, wherein the steering post section comprises a steering post cover member defining an upper surface and an aperture in the upper surface, the steering handle section being connected to the steering post section through the aperture.

8. The steering assembly according to claim 1 in combination with a watercraft having a bow portion and a water spray deflection member configured to guide water spray at least partially upwardly during forward movement of the watercraft, wherein the cover member extends lower than an upper most edge of the deflection member.

9. The steering assembly according to claim 1, wherein the steering post section is configured to be pivotally connected to the hull of the watercraft, thereby allowing the steering post section and the steering handle section to pivot about a pivot axis.

10. The steering assembly according to claim 9, wherein the pivot axis extends generally normal to the steering axis.

11. The steering assembly according to claim 1, in combination with a watercraft having at least a first seat, the seat including a generally U-shaped raised portion configured to extend along the sides of the hips of an operator of the watercraft.

12. A watercraft comprising a hull, a propulsion device supported by the hull and configured to generate thrust to propel hull, the hull defining a rider's area, the rider's area including a seat and a steering assembly disposed forwardly from the seat, the steering assembly being configured to allow an operator of the watercraft to steer the watercraft, the steering assembly comprising a steering post section and a steering handle section, the steering handle section including a steering member configured to be grasped by a human, the steering handle section being configured to be rotatable relative to the steering post section about a steering axis, and a steering assembly cover extending over a boundary between the steering handle section and the steering post section.

13. The watercraft according to claim 12, wherein the boundary between the steering post section and the steering handle section extends generally normal to the steering axis.

14. The watercraft according to claim 12, wherein the steering assembly cover extends over at least a portion of the boundary disposed on a forward facing portion of the steering assembly.

15. The watercraft according to claim 12, wherein the steering post section and the steering handle section are configured to pivot about a pivot axis.

16. The watercraft according to claim 15, wherein the pivot axis extends generally normal to the steering axis.

17. The watercraft according to claim 12, wherein the seat comprises a seating surface and generally U-shaped raised portion extending around a rearward area of the seating surface.

18. The watercraft according to claim 17, wherein the generally U-shaped raised portion is configured to extend along sides of a rider's hips when seated on the seat.

19. A watercraft comprising a hull, a propulsion device for propelling the hull, a steering device configured to allow an operator to steer the watercraft, the steering device comprising a steering post section and a steering handle section which is rotatable relative to the steering post section, and means for shielding a boundary between the steering post section and the steering handle section from water spray.

20. The steering assembly according to claim 1, additionally comprising a clearance between the steering post section and the steering handle section, wherein the cover member extends over the boundary between the steering post section and the steering handle section so as to block water spray from flowing into the clearance.

21. The watercraft according to claim 12 additionally comprising a clearance between the steering post section and the steering handle section, wherein the steering assembly cover extends over the boundary between the steering post section and the steering handle section so as to block water spray from flowing into the clearance.

* * * * *